US005878509A

United States Patent [19]

Burnett

[11] Patent Number: 5,878,509

[45] Date of Patent: Mar. 9, 1999

[54] BAFFLED WOOD DRYING KILN AND PROCESS

[75] Inventor: Jonathan T. Burnett, Post Falls, Id.

[73] Assignee: IFI, Inc., Coeur d'Alene, Id.

[21] Appl. No.: 813,044

[22] Filed: Mar. 7, 1997

[51] Int. Cl.[6] ..... F26B 21/02

[52] U.S. Cl. ..... 34/557; 34/218; 34/231; 415/212.1; 415/224

[58] Field of Search ..... 34/191, 230, 231, 34/557, 218, 219, 307, 309, 311; 415/212.1, 224

[56] References Cited

U.S. PATENT DOCUMENTS

| | | | |
|---|---|---|---|
| 3,196,554 | 7/1965 | Smith | 34/557 |
| 4,972,604 | 11/1990 | Breckenridge | 34/34 |
| 5,050,314 | 9/1991 | Breckenridge | 34/345 |
| 5,195,251 | 3/1993 | Gyurcsek | 34/22 |
| 5,414,944 | 5/1995 | Culp | 34/218 |
| 5,437,109 | 8/1995 | Culp | 34/231 |
| 5,488,785 | 2/1996 | Culp | 34/307 |

*Primary Examiner*—Henry Bennett
*Assistant Examiner*—Pamela A. Wilson
*Attorney, Agent, or Firm*—Wells, St. John, Roberts, Gregory & Matkin P.S.

[57] ABSTRACT

A wood drying kiln and airflow controlling process is described in which the kiln includes an structure with a charge receiving chamber, and a door accessible opening to allow passage of a charge of lumber for drying. Circulating fans in the structure produce airflow that is directed by baffles in a prescribed path through the charge. At least one row of elongated resilient brush bristles within the structure are positioned therein to yieldably engage the charge of lumber placed within the charge receiving chamber. The brush bristles are provided with sufficient density to limit passage of air laterally through the row.

23 Claims, 4 Drawing Sheets

BAFFLED WOOD DRYING KILN AND PROCESS

TECHNICAL FIELD

The present invention relates to drying of lumber in drying kilns and more particularly to control of airflow within such kilns.

BACKGROUND OF THE INVENTION

Drying kilns are used at saw mills and treatment plants to lower the moisture content of lumber to a selected desired level. The lumber fed into drying kilns is typically "green" lumber, cut from previously living trees and that typically has high moisture content. The lumber is dried usually by application of heat and airflow directed through and around layers of lumber arranged in stacks forming a charge within the kiln chamber.

Drying kilns are a faster alternative and more consistently controllable than air drying. Stacks of lumber may be effectively dried in just over two days, depending of course on the species of wood, initial moisture content, and other considerations that can affect drying time. On the other hand, air drying of the same material may take several months or more. Expediency is clearly an advantage in kiln drying over air drying, but need remains for efficient kiln systems that will provide for expeditious drying at low cost.

A "charge" of lumber is comprised of at least one stack of boards with layers separated by thin transverse slats termed "stickers." The stickers are used at spaced locations along the layers to form air passages in the stack. It is an objective in drying kilns to move drying air through the charge in an even manner so the individual boards will dry uniformly. Thus it is desirable to have substantially equal airflow through each of the spaces formed by the stickers. This is not possible at the top of the typical charge, since the top layer of lumber is exposed. As a result, various baffle arrangements have been devised to engage the top of the charge and prevent or control airflow across the top board layer.

One common baffle arrangement involves long baffle plates that are hinged to the ceiling or fan deck of the kiln and that can be pivoted up to positions clear of an incoming charge of lumber. Once the charge is positioned in the kiln, the baffles are pivoted down to engage the top longitudinal corners of the charge and effectively limit airflow across the top layer. In actual practice, the baffles function quite well but are difficult and time consuming to use. A kiln operator must go into the kiln, lift and lock the baffles (which are quite heavy) in an up position before the charge is moved in. Then, once the charge is in place within the kiln, the operator must lower the baffles to engage the top layer. Finally, when the drying process is complete, the operator must again go into the kiln, and raise the baffles to allow the charge of dried lumber to be removed. Shifting the baffles up and down in the kiln is not only hard physical labor (since the baffles are heavy), but the worker is exposed to dark, steamy, unsafe conditions in the kiln. It is not at all unusual for a baffle to accidently strip a board from the top of a charge and onto a worker below. It is also a common occurrence for someone to forget to lift the baffles before a dried charge is taken from the kiln. The baffles will then drag along the top layer of lumber and either be damaged by the lumber, push one or more boards off the top of the charge, or simply swing down to positions in a collision path with the next incoming charge of lumber.

As a solution to the baffle problem discussed above, attempts have been made to eliminate or modify the baffle construction in drying kilns. For example, U. S. Pat. No. 5,488,785 granted to George Culp on Feb. 6, 1996, recognizes the need to effectively control air passage over a charge of lumber in a dry kiln. The solution offered is provision of flat panels that are positioned on the top layers of the charge. Placement of the panels is a time consuming task, requiring the use of a fork lift truck to hoist and place the panels in place, then to remove the panels after drying.

Another attempted solution to the dry kiln baffle problems discussed above is disclosed in U.S. Pat. No. 4,972,604 granted to Leon Breckenridge on Nov. 27, 1990. This patent discloses the use of inflatable bladders that are positioned in a dry kiln and inflate to engage the charge of material to be dried, thereby confining the passage of air through the kiln chamber to prescribed passages. However, the time required to inflate the bags becomes a negative factor, as well as the propensity for the inflated bags to burst when inflated against sharp splinters. Still further, the high pressure pumps required to properly operate the bags adversely affects the overall cost of the baffling unit.

Still other attempts have been considered, including flexible cloth or canvass aprons draped loosely against the top surface of a charge within a kiln. Such drapes often snag, wear quickly, or may be too flexible to adequately control airflow in the drying chamber.

A need has therefore remained for a drying kiln baffle system that will operate to influence airflow within a drying kiln without requiring manual or automatic positioning. A need further remains for a baffle that is relatively safe to operate and that in normal use, will not drag lumber from a dry kiln charge as the charge is being moved into or out from the drying kiln.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
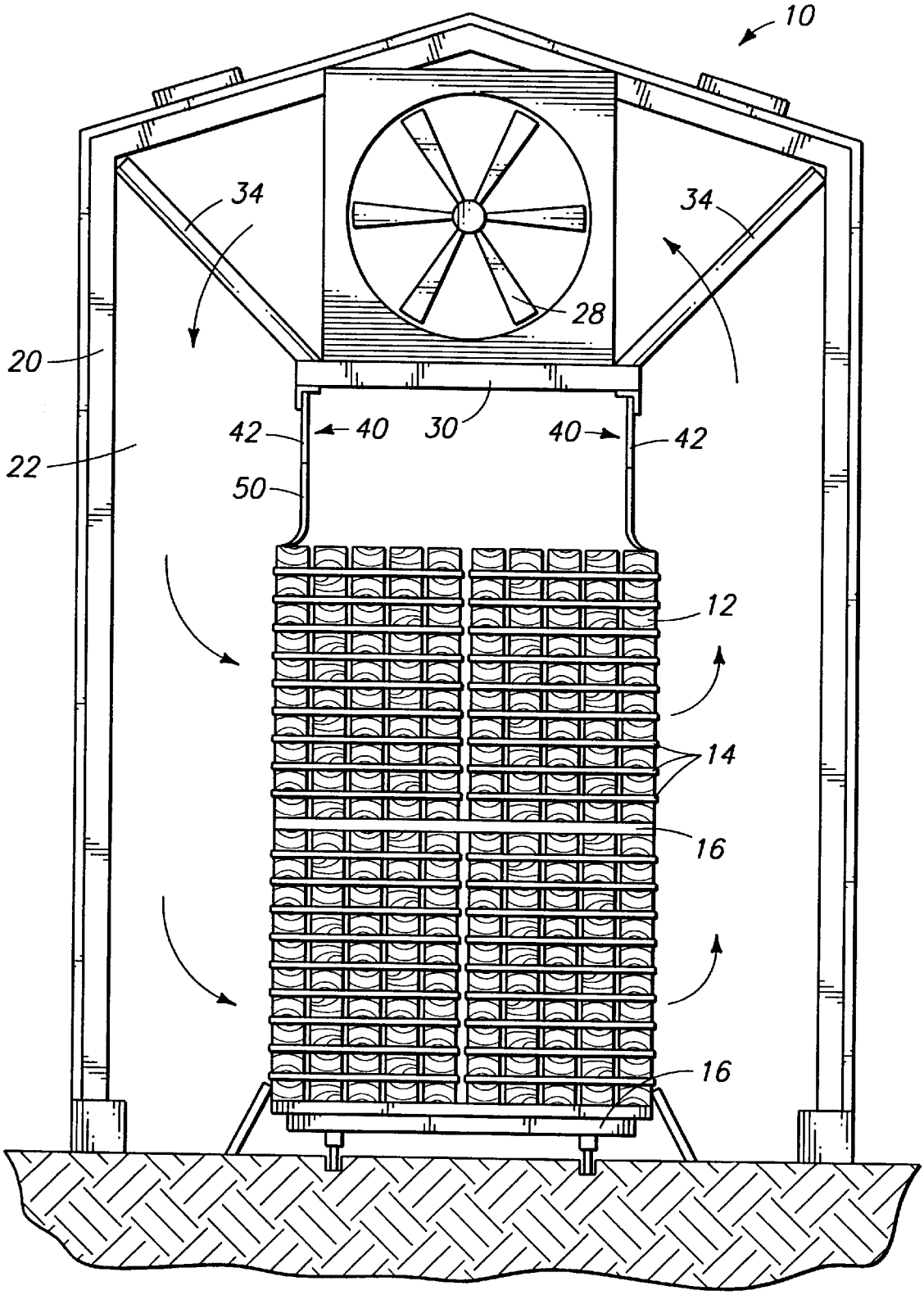
FIG. 1 of the drawings is a substantially schematized transverse sectional view of a dry kiln incorporating features of the present invention.

This disclosure of the invention is submitted in furtherance of the constitutional purposes of the U.S. Patent Laws "to promote the progress of science and useful arts" (Article 1, Section 8).

In a preferred form of the present invention, a wood drying kiln 10 is provided for drying one or more stacks formed as a charge 12 of lumber. A single charge 12 of lumber is made up of multiple layers of boards stacked in a rectangular configuration with stickers 14 separating successive layers. Depending upon the size and configuration of the kiln 10, which may vary according to need, several stacks may be dried simultaneously. Thus a charge 12 may be comprised of numbers of lumber stacks arranged within the kiln 10. The stacks may be placed, one on another and are typically separated by bolsters 16 which are larger in cross section than the stickers 14 to facilitate access to the individual stacks by fork lift tines.

Stickers 14 are placed between successive layers of lumber in the stacks to facilitate circulation of drying air and to expose the surfaces of the boards in the stack to the air. The drying kiln 10 is used to move drying air that is typically heated and may contain controlled amounts of moisture that are added periodically to encourage even, progressive drying of the charge 12. The present invention is provided to assist controlled airflow throughout the kiln interior and the charge 12 of lumber.

In a preferred form, the present kiln 10 includes an enclosure structure 20 including a charge 12 receiving chamber 22. The structure 20 defines at least one, and preferably two opposed openings 24 leading to the charge 12 receiving chamber 22. The openings 24 are sized to allow passage of a charge 12 of lumber into the chamber 22 for drying and to subsequently allow discharge of the charge 12 after drying.

Appropriate doors 26 are provided on the structure 20 operable to selectively open or close the openings 24. Additional bi-fold doors 27 (FIG. 2) may also be provided within the chamber 22, inwardly of the doors 26, to engage the ends of the charge 12 and prevent airflow across the charge ends.

Figure 2:
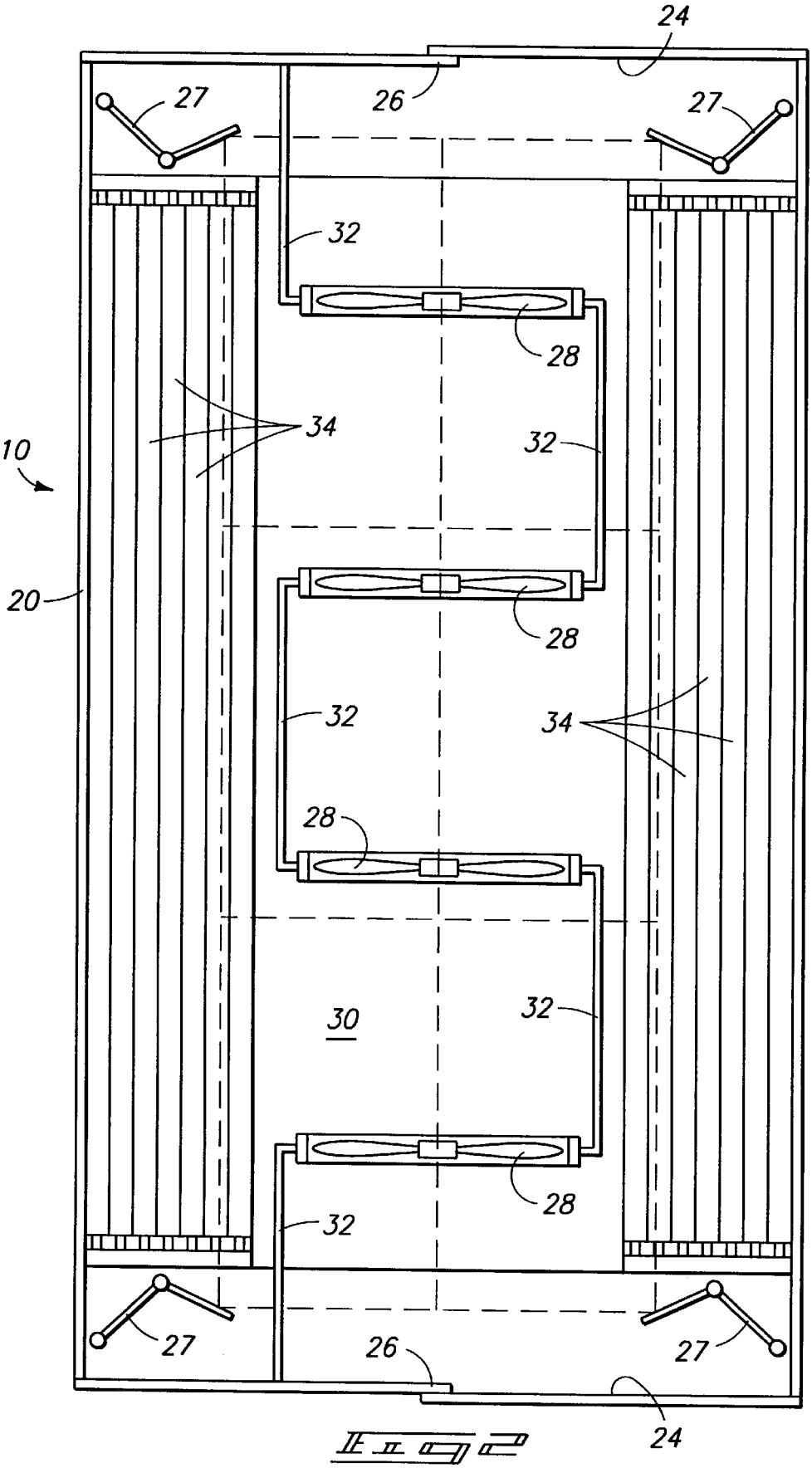
FIG. 2 is a substantially schematized longitudinal sectional view of the dry kiln shown in FIG. 1.

Circulating fans 28 are provided in the preferred kiln 10, operably mounted to the structure 20 and configured to produce airflow within the charge receiving chamber 22. A plurality of the fans 28 may be provided, situated within the structure 20 above the charge 12 and separated therefrom by a fan deck 30. In the example illustrated, the fans 28 are reversible and are capable of producing airflow in opposed longitudinal directions. An airflow diverter 32 formed in a castellated shape is positioned in relation to the fans 28 as shown in FIG. 2 to redirect airflow laterally, depending upon the direction of rotation of the fan blades. Referring to FIG. 2, rotation of the fans 28 in one direction, will result in an airflow against the diverter 32 which in turn will produce an airflow moving from left to right. Reverse rotation of the fans 28 will result in airflow against an opposed configuration of the diverter 32, producing a resultant airflow from right to left. This arrangement is common to many forms of existing kilns.

The fan deck 30 of the preferred example shown in FIG. 1 is centered in the chamber 22 above the charge 12, leaving spaces on opposed longitudinal sides for passage of air. The spaces are occupied by finned pipes 34 that receive heated fluid such as steam from a conventional source (not shown). Air moving through the chamber 22 passes through the finned pipes 34 and is heated by conduction as it contacts and moves through the pipes 34. Airflow through the chamber 22 is indicated by arrows in FIG. 1, moving in a counter clockwise direction. Reversal of the fans 28 will result in airflow moving in an opposite direction.

In the preferred form of the present invention, baffles 40 are provided within the structure 20 and are arranged to direct airflow produced by the circulating fans 28 in a prescribed path within the charge receiving chamber 22. The "prescribed path" referred to is a lateral path through the separated layers of boards in the charge 12. The direction of the path will vary according to the rotational direction of the fans 28. Thus the direction shown in FIG. 1 is left to right. Reversal of the fans 28 will result in the direction shifting to a right to left airflow.

The present baffle 40, in a preferred form, is situated within the chamber 22 and depends from the fan deck 30. One baffle 40 is provided along each longitudinal edge of the fan deck 30. The baffles 40 extend downwardly from the fan deck 30 to yieldably engage the top surface of the charge 12, preferably engaging along the longitudinal top edges of the charge 12. The baffles 40 are thus arranged to block airflow across the top surface of the charge 12. However, the spaces defined by the stickers 14 remain open so airflow will be permitted between the successive layers of lumber 12.

Figure 3:
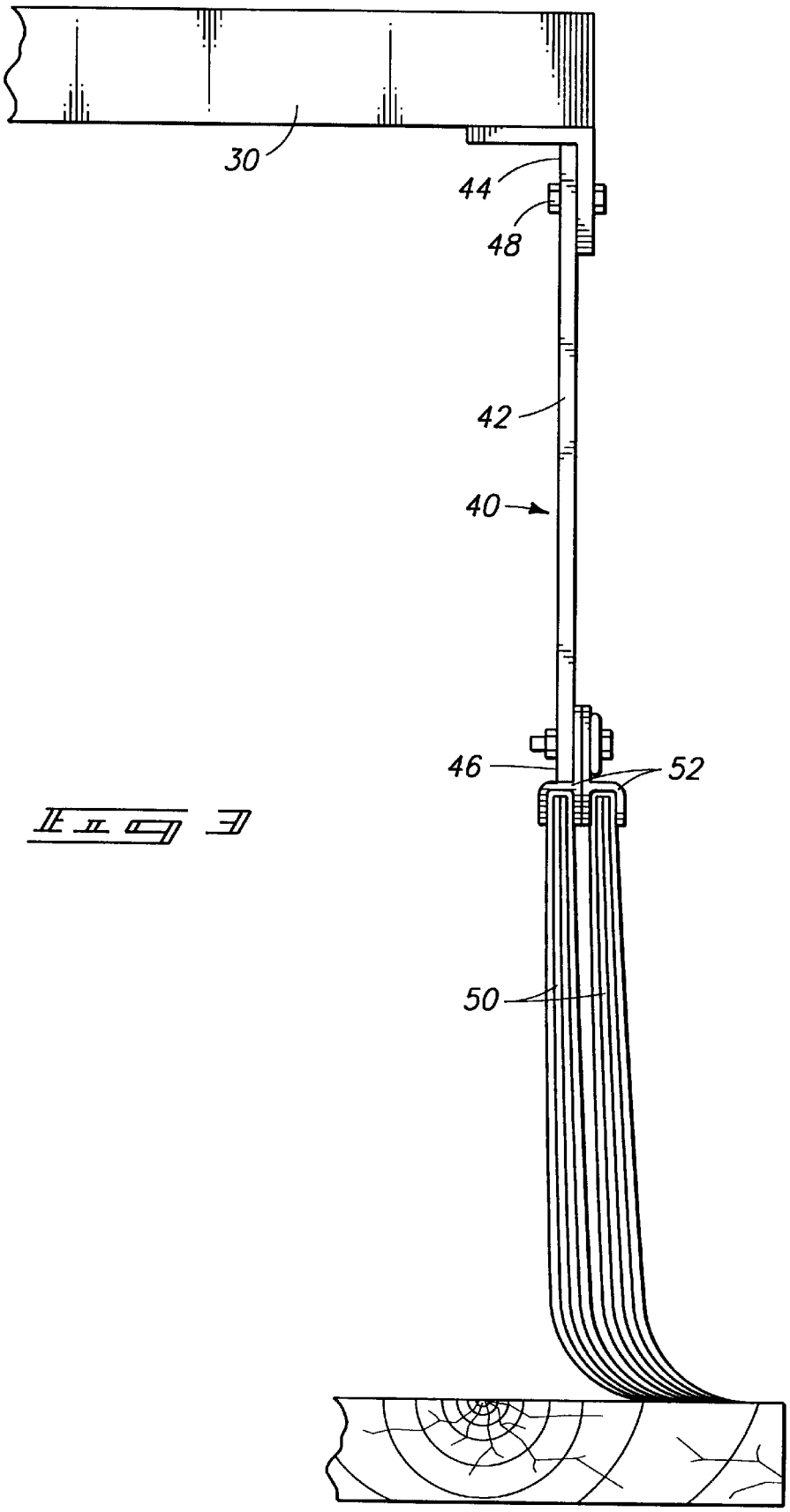
FIG. 3 is an enlarged fragmented view of the presently preferred baffle and brush bristle configuration.
Figure 4:
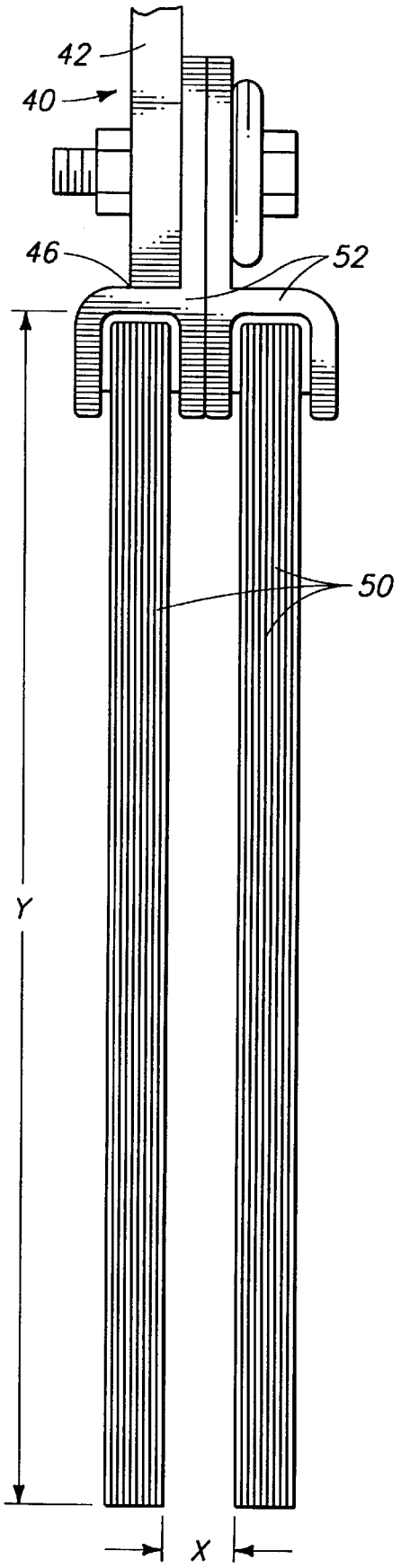
FIG. 4 is a further enlargement of the preferred baffle and brush bristle configuration.

The present invention also includes the specific baffle 40 in a system for the wood drying kiln 10 in which at least one but preferably two baffle plates 42 are provided (FIGS. 3, 4). Each plate 42 includes opposed first and second edges 44, 46 respectively. The baffle plates 42 may be formed of sheet aluminum, steel, or another appropriate rigid material that will retain its configuration under exposure to relatively high temperatures. The height of the plates 42 is selected according to the distance (vertical) from the top edge of the structure openings 24 to the bottom surface of the fan deck 30. This is done to protect the plates 42 from damage by incoming charges of lumber. A charge 12 that will fit through the openings 24 will not hit and bend the plates 42 unless the charge 12 is lifted when in the chamber 22 (an occurrence that is not likely since the charges are typically moved on rails into and out from the kiln 10).

Mounts 48 are provided on each baffle plate 42, configured to secure the baffle plate 42 within the wood drying kiln 10. The nature of the mount 48 may vary according to the installation, and may therefore take numerous forms that would be well within the skill of a millwright or kiln designer. Examples are bolt and nut combinations, screws, rivets, or other appropriate fasteners secured through prepared surfaces such as drilled holes formed through the plates 42 and the structure 20 to which the plates 42 are to be attached.

In preferred forms of the invention, at least one row of elongated resilient brush bristles 50 are operably mounted within the structure 20 and positioned therein to yieldably engage successive charges of lumber placed within the charge receiving chamber 22. Most preferably, the brush bristles 50 are mounted to the baffle plates 42 adjacent to or at the second edges 46 (FIGS. 3, 4).

The bristles 50 extend downwardly from the second baffle plate edges 46 below the top edge of the openings 24 to resiliently engage the top surface of a charge 12 received within the chamber 22. The brushes will flex against the top surface of the charge 12 as shown in FIG. 3, but will effectively prevent lateral airflow through the bristles 50.

In preferred forms, the brush bristles 50 are formed of a flexible plastic material. More specifically, the bristles 50 are formed of polypropylene brush material. It has been found that this particular material functions well in kilns due to its resistance to temperatures normally used for drying lumber 12, and will wear well under kiln operating conditions.

In a preferred form the individual brush bristles 50 have length dimension Y (FIG. 4) of between approximately 4 and 12 inches (10.16 and 35.56 centimeters) from a brush base 52. It has been found that the preferred bristle configuration using this range of length functions well to block passage of air and to avoid disturbing boards as they are engaged when moving into or out from the chamber 22. Significantly shorter bristles 50 will not deflect appropriately and can shift smaller boards as the charge 12 is moved, thus endangering any workers in the vicinity. Significantly longer bristles 50 become too flexible and allow undesirable spaces to form between the bristles 50 and permit undesirable airflow across the top surface of the charge 12. Individual bristle diameters may vary but fall generally within an approximate range of 0.0156–0.039 inches (0.4–1 millimeters).

The preferred brush bristles 50 are of sufficient density along the row defined by the brush bases 52, to limit passage of air laterally through the row when the bristles 50 are engaged substantially as shown in FIG. 3 against the top surface of a charge 12 in the kiln 10. A preferred exemplary density of bristles held in the bases 52 is approximately 200–300 bristles per inch (80–120 bristles per centimeter), with each baffle plate 42 mounting two rows of bristles 50 with the bristle base parts 52 spacing the rows apart laterally by a distance X (FIG. 4) of less than approximately 1.5 inches (3.81 centimeters). Most preferably the distance is approximately 0.635 inches (1.613 centimeters).

FIG. 4 shows an arrangement whereby the bristle base parts 52 are secured to the baffle plates 42. The bases 52 are formed in "h" configuration, with the long upright leg parts of the "h" shape bolted together and to the baffle plate adjacent its second edge 46. The bolted together base parts thus determine the spacing between rows of bristles 50.

It is preferred in practice that the rows of bristles 50 and the baffle plates 42 extend longitudinally within the chamber 22 a distance at least equal to the longest charge 12 to be delivered to the kiln 10. Thus the entire length of the charge 12 will be engaged by the bristles 50. Airflow across the top of the charge 12 will thus be eliminated, regardless of the airflow direction (right to left or left to right). Further, the bristles 50 will easily flex when engaged by the charge 12 and form the barrier to lateral airflow across the top of the charge without requiring any controlled movement of the baffle plates 42 or bristles 50. The baffle plates 42 and bristles 50 may remain in position once installed and will not require further service other than periodical cleaning.

The present invention further includes a process for producing the wood drying kiln 10, including steps involving the elements and apparatus described above.

The preferred steps include providing an enclosure structure 20 including a charge receiving chamber 22. This step may be accomplished using conventional kiln construction techniques. Further the size and configuration of the kiln structure 20 may vary according to need.

Another step involves producing an opening in the structure 20 leading to the charge receiving chamber 22. The opening produced is of a shape sufficient to allow passage of a prescribed shaped charge of lumber for drying into and out from the charge receiving chamber 22. Again conventional kiln construction techniques and materials may be performed to complete this step.

A further step involves providing a door 26 on the structure 20 operable to selectively open or close the opening. Each door 26 may be a conventional kiln door, and may be provided on appropriate rollers or hinges to selectively close the openings. This step may also be performed using conventional kiln construction techniques and apparatus. In addition, it is useful to provide internal doors 27 within the chamber 22 that can be selectively closed against a charge 12 (FIG. 2) in the chamber to prevent airflow across the opposed ends of the charge.

Another step involves providing circulating fans 28 on the structure 20 to produce airflow within the charge receiving chamber 22. The fans 28 may be arranged as shown in FIG. 2, or other arrangements may be used that also are well known in the kiln producing arts.

A still further step involves arranging baffles 40 within the structure 20 to direct airflow produced by the circulating fans 28 in a prescribed path within the charge receiving chamber 22. The baffles 40 with brush bristles 50 described above are most preferably used in accomplishing this step.

As a next step, at least one row of elongated resilient brush bristles 50 are positioned in the chamber 22, the bristles 50 having sufficient density to limit passage of air laterally through the row within the chamber 22 to yieldably engage successive charges 12 of lumber placed within the charge receiving chamber 22.

The bristles 50 are used in the present process for controlling airflow in the described wood drying kiln 10. The steps involved include arranging baffles 40 within the structure 20 to direct airflow produced by the circulating fans 28 in a prescribed path within the charge receiving chamber 22.

Next, at least one row of elongated resilient brush bristles 50 having sufficient density to limit passage of air laterally through the row within the chamber 22 are positioned to yieldably engage successive charges 12 of lumber placed within the charge receiving chamber 22. The positioning step is accomplished by mounting the row of brush bristles 50 on the baffles 40 at a position to resiliently engage and flex against a charge 12 of lumber within the chamber 22. More preferably, the positioning step is accomplished by mounting two rows of brush bristles 50 on each of the baffles 40, the rows of brush bristles 50 on each baffle being spaced apart by a distance of less than approximately 1.5 inches (3.81 centimeters).

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A wood drying kiln, including:

an enclosure structure including a charge receiving chamber;

the structure defining an opening leading to the charge receiving chamber and sized to allow passage of a charge of lumber for drying;

a door on the structure operable to selectively open or close the opening;

circulating fans operably mounted to the structure and configured to produce airflow within the charge receiving chamber;

baffles within the structure arranged to direct airflow produced by the circulating fans in a prescribed path within the charge receiving chamber; and at least one row of elongated resilient brush bristles operably mounted within the structure and positioned therein to yieldably engage successive charges of lumber placed within the charge receiving chamber; and wherein the brush bristles are of sufficient density to limit passage of air laterally through the row.

2. A wood drying kiln as defined by claim 1 wherein the brush bristles are formed of a flexible plastic material.

3. A wood drying kiln as defined by claim 1 wherein the brush bristles are formed of polypropylene brush material.

4. A wood drying kiln as defined by claim 1 wherein the brush bristles are formed of polypropylene brush material having a length dimension of between approximately 4–14 inches or 10.16–35.56 centimeters.

5. A wood drying kiln as defined by claim 1 wherein the brush bristles are formed of polypropylene brush material having a length dimension of approximately 4–14 inches or 10.16–35.56 centimeters and wherein the brush bristles are formed arranged in two rows spaced apart laterally by a distance of approximately 0.635 inches or 1.613 centimeters.

6. A wood drying kiln as defined by claim 1 wherein the brush bristles are formed of a flexible plastic material arranged in two rows spaced apart laterally by a distance of less than 1.5 inches or 3.81 centimeters.

7. A wood drying kiln as defined by claim 1 wherein the brush bristles are formed of a flexible plastic material in a density along the row of approximately 200–300 bristles per inch or 80–120 bristles per centimeter.

8. A wood drying kiln as defined by claim 1 wherein the brush bristles are formed of a flexible plastic material in a density along the row of approximately 200–300 bristles per inch or 80–120 bristles per centimeter and wherein the bristles are arranged in two rows spaced apart laterally by a distance of less than 1.5 inches or 3.81 centimeters.

9. A baffle system for a wood drying kiln, including:

a baffle plate including opposed first and second edges;

a mount on the baffle plate configured to secure the baffle plate within the wood drying kiln;

at least one row of elongated resilient brush bristles mounted to the baffle plate and extending therefrom; and wherein the brush bristles are of sufficient density to limit passage of air laterally through the row.

10. A wood drying kiln as defined by claim 9 wherein the brush bristles are mounted to the second edge of the baffle plate.

11. A wood drying kiln as defined by claim 9 wherein the brush bristles are formed of a flexible plastic material.

12. A wood drying kiln as defined by claim 9 wherein the brush bristles are formed of a flexible polyethylene plastic material.

13. A wood drying kiln as defined by claim 9 wherein the brush bristles are formed of a flexible polyethylene plastic material each bristle having an approximate cross sectional diameter of 0.0156–0.039 inches or 0.4–1 millimeters and a length dimension of approximately 4–14 inches or 10.16–35.56 centimeters.

14. A wood drying kiln as defined by claim 9 wherein there are two rows of brush bristles on the baffle plate, mounted adjacent the second edge thereof.

15. A wood drying kiln as defined by claim 9 wherein there are two rows of brush bristles on the baffle plate, mounted adjacent the second edge thereof and spaced apart laterally by a distance less than approximately 1.5 inches or 3.81 centimeters and at a density along the rows of approximately 200–300 bristles per inch or 80–120 bristles per centimeter.

16. A wood drying kiln as defined by claim 9 wherein there are two rows of brush bristles on the baffle plate, mounted adjacent the second edge thereof and spaced apart laterally by a distance less than approximately one 1.5 inches or 3.81 centimeters.

17. A process for producing a wood drying kiln, including the steps of:

providing an enclosure structure including a charge receiving chamber;

producing an opening in the structure leading to the charge receiving chamber of a shape to allow passage of a prescribed shaped charge of lumber for drying into and out from the charge receiving chamber;

providing a door on the structure operable to selectively open or close the opening;

providing circulating fans on the structure to produce airflow within the charge receiving chamber;

arranging baffles within the structure to direct airflow produced by the circulating fans in a prescribed path within the charge receiving chamber; and positioning at least one row of elongated resilient brush bristles having sufficient density to limit passage of air laterally through the row within the chamber to yieldably engage successive charges of lumber placed within the charge receiving chamber.

18. A process for producing a wood drying kiln as defined by claim 17, wherein the step of positioning at least one row of elongated resilient brush bristles having sufficient density to limit passage of air laterally through the row within the chamber to yieldably engage successive charges of lumber placed within the charge receiving chamber includes the step of providing brush bristles formed of a flexible plastic material.

19. A process for producing a wood drying kiln as defined by claim 17, wherein the step of positioning at least one row of elongated resilient brush bristles having sufficient density to limit passage of air laterally through the row within the chamber to yieldably engage successive charges of lumber placed within the charge receiving chamber includes the step of providing brush bristles formed of a flexible polyethylene plastic material.

20. A process for producing a wood drying kiln as defined by claim 17, wherein the step of positioning at least one row of elongated resilient brush bristles having sufficient density to limit passage of air laterally through the row within the chamber to yieldably engage successive charges of lumber placed within the charge receiving chamber includes the step of providing two rows of brush bristles spaced apart laterally by a distance less than approximately 1.5 inches or 3.81 centimeters.

21. A process for controlling airflow in a wood drying kiln having a charge receiving chamber for receiving a charge of lumber and circulating fans operably mounted to the structure and configured to produce airflow within the charge receiving chamber, including the steps of:

arranging baffles within the structure to direct airflow produced by the circulating fans in a prescribed path within the charge receiving chamber; and positioning at least one row of elongated resilient brush bristles having sufficient density to limit passage of air laterally through the row within the chamber to yieldably engage successive charges of lumber placed within the charge receiving chamber.

22. A process for controlling airflow in a wood drying kiln having a charge receiving chamber for receiving a charge of lumber and circulating fans operably mounted to the structure and configured to produce airflow within the charge receiving chamber as defined by claim 21, wherein the step of positioning at least one row of elongated resilient brush bristles having sufficient density to limit passage of air laterally through the row within the chamber to yieldably engage successive charges of lumber placed within the charge receiving chamber is accomplished by mounting the row of brush bristles on the baffles at a position to resiliently engage and flex against a charge of lumber within the chamber.

23. A process for controlling airflow in a wood drying kiln having a charge receiving chamber for receiving a charge of lumber and circulating fans operably mounted to the structure and configured to produce airflow within the charge receiving chamber as defined by claim 21, wherein the step of positioning at least one row of elongated resilient brush bristles having sufficient density to limit passage of air laterally through the row within the chamber to yieldably engage successive charges of lumber placed within the charge receiving chamber is accomplished by mounting two rows of brush bristles on each of the baffles, the rows of brush bristles on each baffle being spaced apart by a distance of less than approximately 1.5 inches or 3.81 centimeters.

* * * * *